United States Patent [19]

Atkins et al.

[11] Patent Number: 4,539,961

[45] Date of Patent: Sep. 10, 1985

[54] FUEL RAIL

[75] Inventors: Terrance J. Atkins, Rochester; Martin J. Field, Churchville; Donald J. Lamirande, Spencerport, all of N.Y.

[73] Assignee: General Motors Corporation, Detroit, Mich.

[21] Appl. No.: 410,612

[22] Filed: Aug. 23, 1982

[51] Int. Cl.[3] ..... F02M 39/00

[52] U.S. Cl. ..... 123/468; 123/516; 123/469; 137/271

[58] Field of Search ..... 123/468, 469, 470, 471, 123/456, 514, 516, 467; 137/883, 884, 269, 271

[56] References Cited

U.S. PATENT DOCUMENTS

| | | | |
|---|---|---|---|
| 3,076,473 | 2/1963 | Wadey | 137/271 |
| 3,817,273 | 6/1974 | Erwin | 123/516 |
| 4,149,496 | 4/1979 | Palma | 123/469 |
| 4,286,563 | 9/1981 | Fahim | 123/469 |
| 4,294,215 | 10/1981 | Hans | 123/469 |
| 4,395,988 | 8/1983 | Knapp | 123/511 |
| 4,457,280 | 7/1984 | Hudson | 123/470 |

*Primary Examiner*—Carl Stuart Miller

*Attorney, Agent, or Firm*—C. K. Veenstra

[57] ABSTRACT

A fuel rail supporting injectors for delivering fuel to an engine has fuel supply and fuel return passages interconnected through a recess in a plug at each end of the fuel rail. The recesses are calibrated to direct the proper proportion of the fuel past the injectors. The fuel supply passage is configured to allow separation of fuel vapor from the liquid fuel received by the injector and to conform to the shape of the plug and the fuel return passage.

3 Claims, 10 Drawing Figures

FUEL RAIL

TECHNICAL FIELD

This invention provides an improved fuel rail which supports injectors for delivering fuel to an engine.

BACKGROUND

Some fuel injection systems for automotive engines have a plurality of fuel injectors each of which delivers fuel to the inlet port of an associated engine combustion chamber. In some such systems, the fuel injectors are mounted in sockets of a fuel rail which has a passage to supply fuel to the injectors; the fuel rail simplifies installation of the fuel injectors and the fuel supply passage on the engine.

When electromagnetic injectors are employed in such a system, the injectors deliver fuel to the engine in pulses which are timed to control the amount of fuel delivered. The duration of the fuel pulses is calculated to deliver the proper amount of fuel in liquid form, and the fuel system must assure that the fuel injectors receive only liquid fuel; if fuel vapor is entrained in the fuel supplied to the injectors, the fuel pulses will not contain the required amount of fuel.

SUMMARY OF THE INVENTION

This invention provides an improved fuel rail suitable for delivering fuel to an automotive engine. This improved fuel rail assures that fuel vapor which might be formed in the fuel supply passage is separated from the liquid fuel supplied to the injectors.

In a fuel rail according to this invention, a plurality of fuel injector sockets are provided to receive the fuel injectors and a large fuel passage intersects the injector sockets. The fuel passage supplies fuel to the injector sockets, and the injectors deliver fuel from the lower portion of the sockets to the engine. The vertical dimension of the fuel supply passage is substantially greater than its horizontal dimension so that fuel vapor present in the supply passage may separate from the liquid fuel and float along the top of the supply passage while the injector sockets receive only liquid fuel from the bottom of the passage. Accordingly, with a fuel rail according to this invention, both the fuel supply passage and thus the fuel rail may have a narrow cross-section requiring less weight and volume than prior fuel rails.

A fuel rail according to this invention also may include a fuel return passage, and each end of the fuel rail may have a circular recess intersected by and encompassing the ends of the fuel passages, with a circular plug received in and sealing each recess to provide a closure for the associated ends of the fuel passages. With such a structure, according to another aspect of this invention, one of the fuel passages—preferably the fuel supply passage—is provided with an irregular configuration: one side of the fuel supply passage is outwardly convex and conforms substantially to the outline of the circular recess, while the other side of the fuel supply passage is outwardly concave and conforms generally to the configuration of the fuel return passage. The fuel passages are thereby nestled together to permit the smallest possible recess to encompass the fuel passages, thus permitting a very compact fuel rail structure.

In a fuel rail having both a fuel supply passage and a fuel return passage, the connection from the fuel supply line to the fuel supply passage need not be disposed at one end of the fuel rail but instead may be located between the injectors. To assure that the proper amount of fuel is circulated past each of the injector sockets, this invention interconnects the fuel supply passage and the fuel return passage through calibrated recesses in the plugs at each end of the fuel rail. The fuel flow from the fuel supply line is divided with a portion flowing through the supply passage toward each end of the fuel rail, and the calibrated recesses in the plugs assure that the fuel flow along each path is proportioned to the number of injector sockets along that path.

The details of the preferred embodiment as well as other features and advantages of this invention are set forth in the remainder of the specification and are shown in the accompanying drawings.

THE PREFERRED EMBODIMENT

Figure 1:
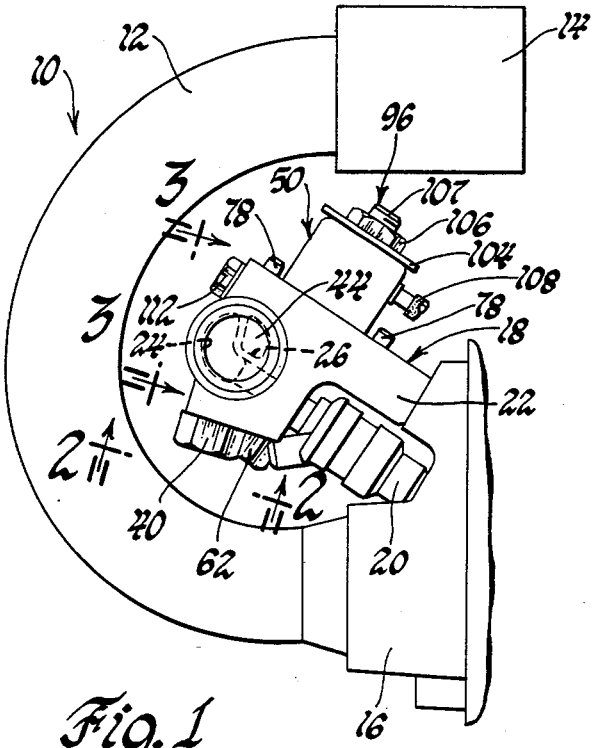
FIG. 1 is an end view of a fuel rail according to this invention mounted on an engine manifold.

Referring to the drawings, the inlet manifold 10 of an automotive spark ignition engine has a plurality of ram tubes 12 extending from a plenum 14 to a mounting pad 16 adjacent the inlet ports for the engine combustion chambers (not shown). A fuel rail 18 is secured on mounting pad 16 and has a plurality of injectors 20 each of which delivers fuel through an opening in mounting pad 16 to one of the inlet ports.

Figure 4:
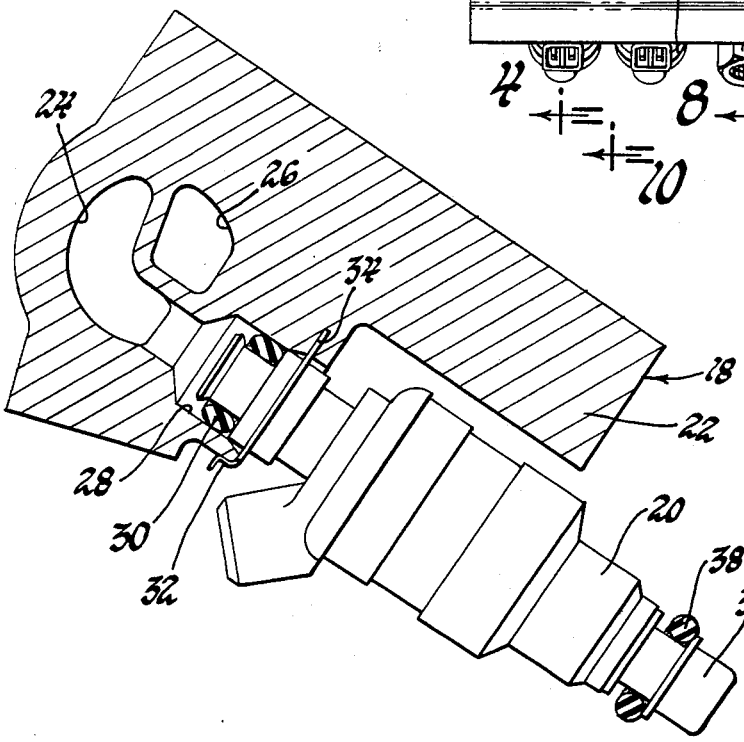
FIG. 4 is a sectional view taken along line 4—4 of FIG. 3 showing the interconnection of an injector and the fuel rail.
Figure 5:
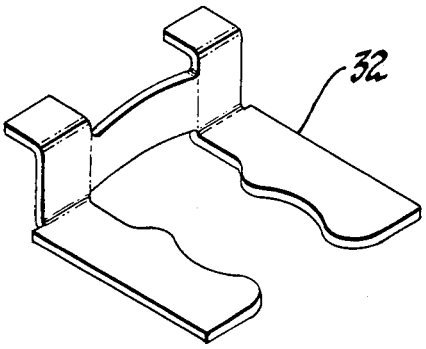
FIG. 5 is a view of a clip employed to secure each injector to the fuel rail.
Figure 6:
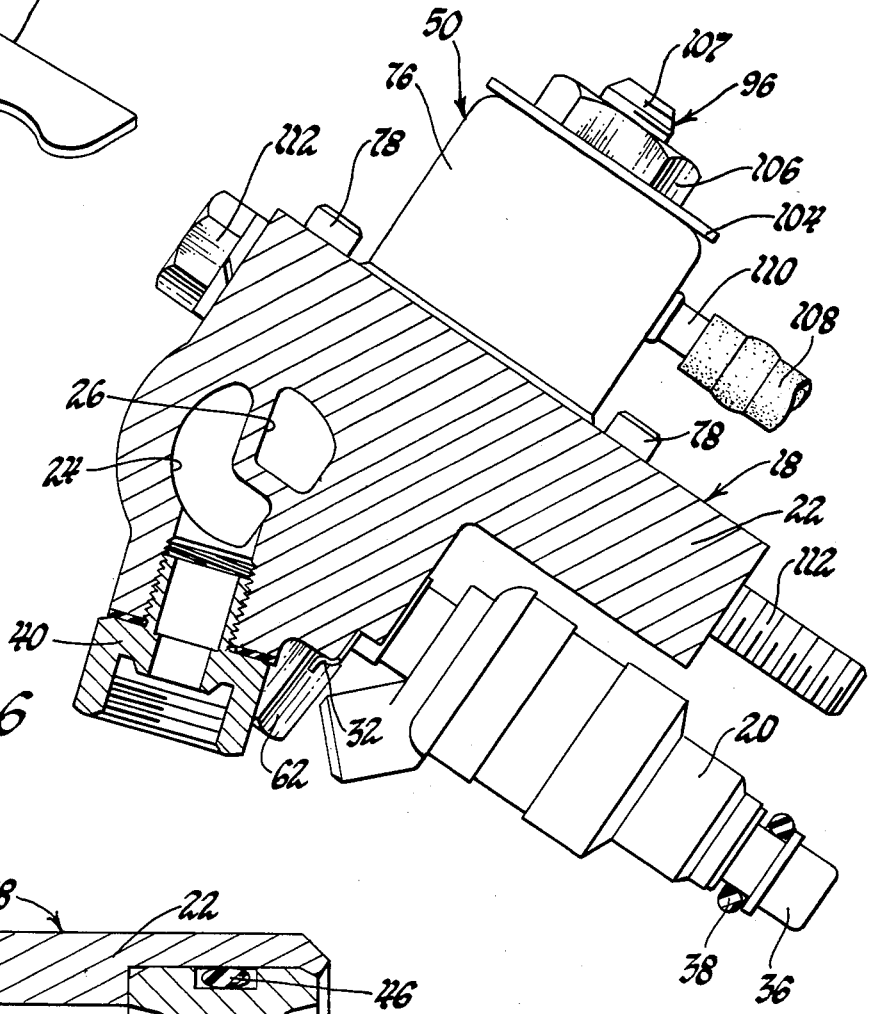
FIG. 6 is a sectional view taken along line 6—6 of FIG. 3 showing the connection of the fuel supply line to the fuel rail.

Fuel rail 18 has an elongated body 22 extruded to form a fuel supply passage 24 and a fuel return passage 26. As shown in FIG. 4, a plurality of injector sockets 28 machined in the fuel rail body 22 are intersected by the lower portion of fuel supply passage 24. Each socket 28 receives an injector 20, with an O-ring 30 sealing the injector-socket interconnection. Each injector 20 is retained in its socket 28 by a clip 32 which surrounds the injector and which is received in a slot 34 machined in the fuel rail body 22. The tip 36 of each injector 20 is received in an opening in manifold mounting pad 16 and has an O-ring 38 to seal the injector-mounting pad interconnection.

Figure 2:
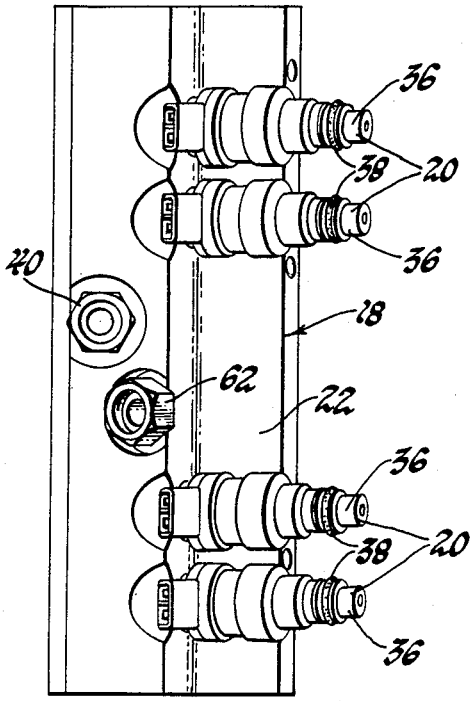
FIG. 2 is an axial view of the fuel rail indicated by the line 2—2 of FIG. 1 but shown removed from the manifold.
Figure 3:
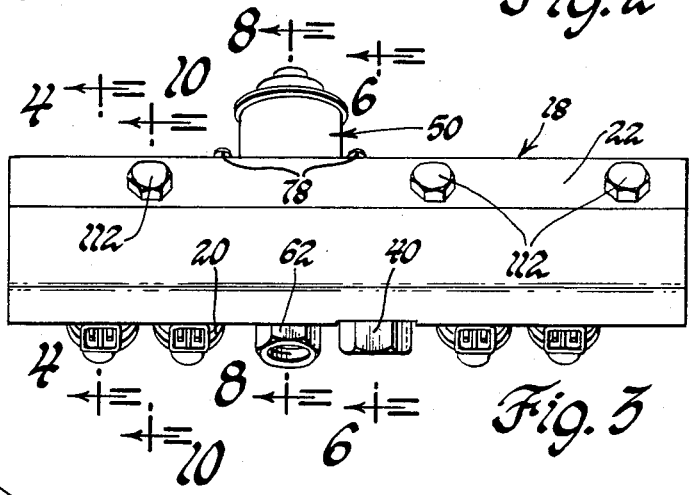
FIG. 3 is an axial view of the fuel rail indicated by the line 3—3 of FIG. 1 but shown removed from the manifold.

Fuel rail 18 has a connection 40 for a line to supply fuel to passage 24. As shown in FIGS. 2 and 3, the fuel supply line connection 40 opens into fuel supply passage 24 toward the middle of fuel rail 18 between two of the injector sockets 28. Fuel entering passage 24 from fuel supply line connection 40 thus flows through passage 24 toward both ends of fuel rail 18.

Figure 7:
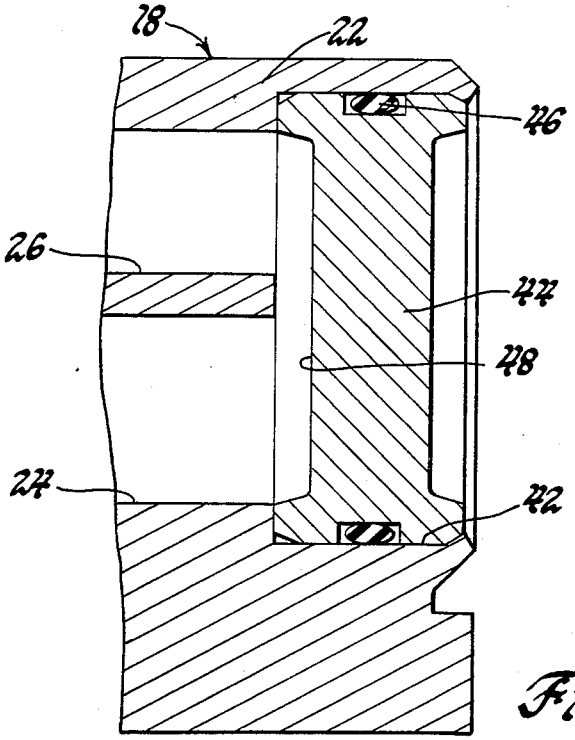
FIG. 7 is a view of one end of the fuel rail with parts broken away to show the recessed plug which connects the fuel supply passage to the fuel return passage.

As shown in FIG. 7, each end of the fuel rail body 22 has a circular recess 42 intersected by and encompassing the associated ends of fuel supply passage 24 and fuel return passage 26. Each recess 42 receives a circular plug 44 sealed by an O-ring 46 to provide a single closure for the associated ends of both fuel passages 24 and 26. Each plug 44 has a recess 48 which interconnects supply passage 24 with return passage 26. The recess 48 in each plug 44 is calibrated so that the fuel flow from fuel supply line connection 40 toward one end of fuel rail 18 is proportioned to the number of injector sockets 28 between connection 40 and that end of fuel rail 18 and so that the fuel flow from fuel supply line connection 40 toward the other end of fuel rail 18 is proportioned to the number of injector sockets 28 between connection 40 and that other end of fuel rail 18. In the specific embodiment of the fuel rail shown in the drawings, there are two injector sockets 28 between connection 40 and each end of fuel rail 18, and plugs 44 have equally sized recesses 48 so that half the fuel flow is directed toward each end of fuel rail 18. However, if connection 40 were located so that there was one injector socket between connection 40 and one end of the fuel rail and three injector sockets between connection 40 and the other end of the fuel rail, recesses 48 would be sized to direct one-quarter of the fuel toward the one injector socket and three-quarters of the fuel toward the other three injector sockets. Moreover, if the fuel rail had only three injector sockets 28, connection 40 would be located so that one injector socket was between connection 40 and one end of the fuel rail and two injector sockets were between connection 40 and the other end of the fuel rail, and recesses 48 would be sized to direct one-third of the fuel toward the one injector socket and two-thirds of the fuel toward the other two injector sockets.

Fuel injectors 20 preferably are conventional electromagnetic fuel injectors energized by a conventional electronic control unit (not shown). Each injector 20 receives fuel from its socket 28 and, when energized, delivers a timed pulse of fuel for mixture with the air which flows to the combustion chambers through manifold 10.

As may be seen in FIGS. 4, 6, 8 and 10, the vertical dimension of fuel supply passage 24 substantially exceeds the horizontal dimension of fuel supply passage 24. Any fuel vapor entrained in the liquid fuel flowing through supply passage 24 thereby collects in the upper portion of supply passage 24, and injector sockets 28 receive only liquid fuel from the lower portion of supply passage 24.

The configuration of supply passage 24 is irregular, one side of supply passage 24 being outwardly convex and conforming substantially to the outline of recesses 42 at the ends of fuel rail 18. The other side of fuel supply passage 24 is outwardly concave, generally conforming to the configuration of and embracing return passage 26. This construction provides a compact fuel rail permitting the smallest possible recesses 42 to encompass supply passage 24 and return passage 26.

Figure 8:
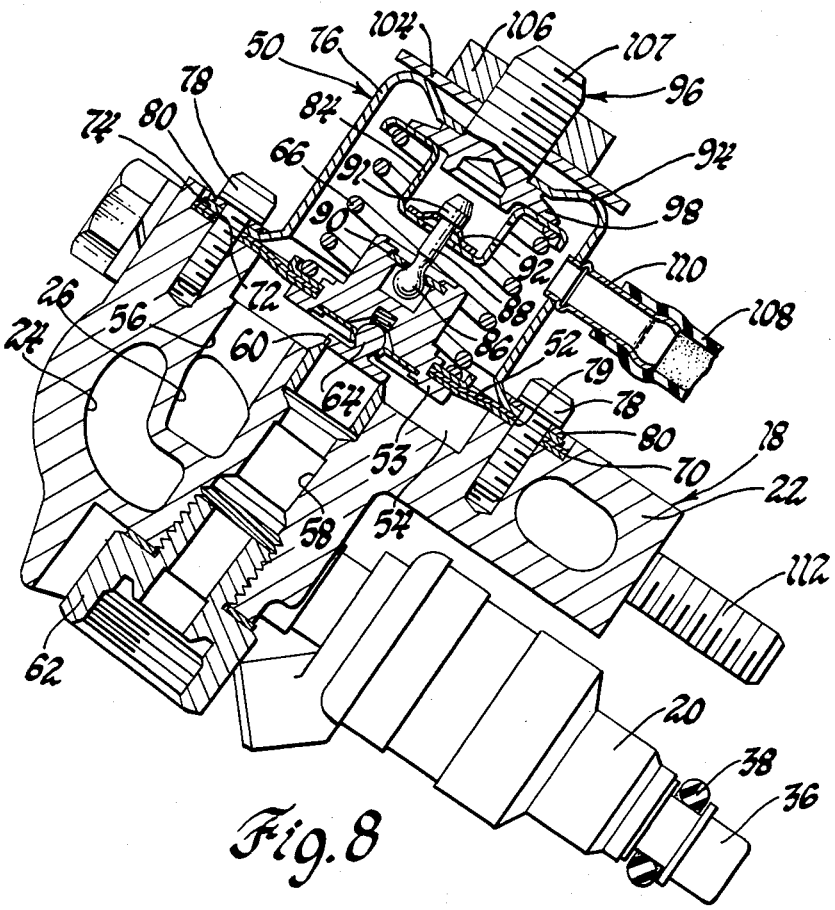
FIG. 8 is a sectional view taken along line 8—8 of FIG. 3 showing the fuel pressure regulator and the connection of the fuel return line to the fuel rail.

As shown in FIG. 8, the body 22 of fuel rail 18 provides a base for a pressure regulator 50. Pressure regulator 50 has a pair of diaphragms 52 which overlie one another to form a single diaphragm unit and which are clamped to and carry a central diaphragm retainer plate 53. Diaphragms 52 overlie body 22 to define a fuel chamber 54. A fuel access region 56 opens from fuel return passage 26 to fuel chamber 54, and a fuel outlet 58 opens from fuel chamber 54 through a valve seat 60 to a fuel return line connection 62. Diaphragm retainer plate 53 carries a valve member 64 which cooperates with valve seat 60, and a spring 66 biases diaphragms 52 to engage valve member 64 with valve seat 60. Pressure regulator 50 controls fuel flow past valve seat 60 balance the fuel pressure in chamber 54 on diaphragms 52 with the bias of spring 66 to thereby maintain a substantially constant fuel pressure in chamber 54 and thus in fuel return passage 26 and fuel supply passage 24.

Diaphragms 52 have an annular sealing region 70 disposed between an annular flange 72 formed in fuel rail body 22 and an annular flange 74 of a pressure regulator spring housing 76. Fastening studs 78 extend through apertures 79 in sealing region 70 to clamp sealing region 70 between flanges 72 and 74. In this particular embodiment a backing ring 80 is secured between the heads of studs 78 and flange 74.

Figure 9:
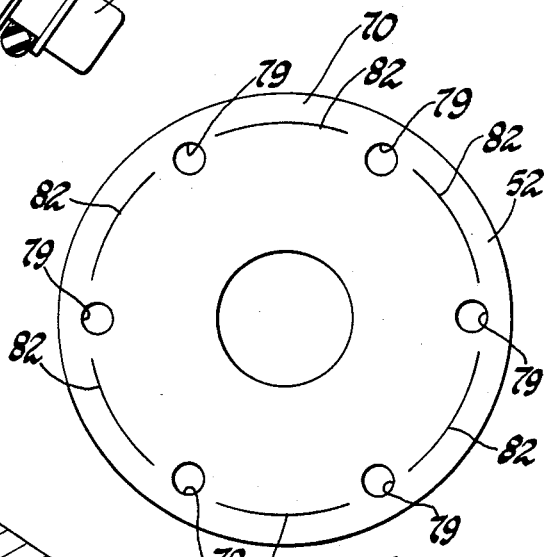
FIG. 9 is a plan view of the pressure regulator diaphragm.

As shown in FIG. 9, each diaphragm 52 has a plurality of slits 82 which extend peripherally around sealing region 70 between apertures 79. The ends of slits 82 are spaced from apertures 79, and slits 82 are located within sealing region 70 slightly outboard of the center of apertures 79. During normal operation, slits 82 have no effect. However, in the event of undue distortion of one of the diaphragms 52, the diaphragm separates along an arcuate line between one of slits 82 and one of the apertures 79 instead of tearing along a radial line from one of apertures 79. Diaphragms 52 thereby maintain a continuous peripheral seal between flanges 72 and 74.

As shown in FIG. 8, the base of spring 66 engages a spring seat 84. A head 86 of a tie rod 88 is captured by a ring 90 secured to diaphragm retainer plate 53, and a bead 91 on tie rod 88 is captured behind spring seat 84 by a push nut 92. Tie rod 88 thus limits movement of spring seat 84 away from diaphragm retainer plate 53 to simplify assembly of pressure regulator 50. Tie rod 88 initially has a tail extending from bead 91; the tail is not shown here because it is removed after securing push nut 92 to tie rod 88.

The base 94 of spring housing 76 overlies spring seat 84 and carries a stud 96 having a flange 98 engaging spring seat 84. Base 94 is axially deformable to move spring seat 84 away from tie rod bead 91 and toward diaphragm plate 53; spring 66 is thereby compressed to increase the bias on diaphragms 52 and thus increase the fuel pressure in chamber 54. In the event that the base 94 of spring housing 76 is overdeformed and overcompresses spring 66, a washer 104 may be placed over base 94 and a nut 106 may then be threaded on the stem 107 of stud 96 to draw flange 98 toward washer 104; base 94 is thereby retracted to compensate for the overdeformation. Washer 104 and nut 106 may then be removed from pressure regulator 50 if so desired.

A hose 108 is connected between a fitting 110 on spring housing 76 and the engine induction system to vent the interior of spring housing 76.

Figure 10:
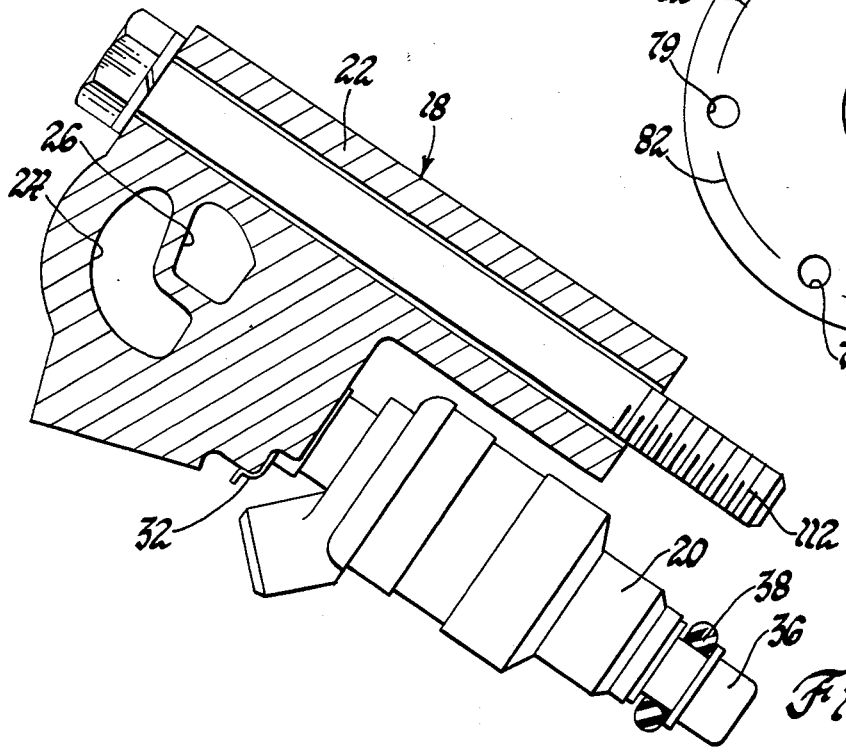
FIG. 10 is a sectional view taken along line 10—10 of FIG. 3 showing a bolt which secures the fuel rail to the manifold.

As shown in FIGS. 1, 3 and 10, fuel rail 18 is secured to manifold mounting pad 16 by three bolts 112.

It will be appreciated that each of the various features of the fuel rail depicted here may be used without employing all of the remaining features. In combination, however, they provide a fuel rail of particularly advantageous construction.

Features of the pressure regulator depicted here were invented by T. J. Atkins and M. J. Field and are claimed in copending application D-6535. Other features employed in the fuel rail depicted here were invented by L. H. Weinand as claimed in copending application D-5728.

The embodiments of the invention in which an exclusive property or privilege is claimed are defined as follows:

1. A fuel rail for an engine, said rail comprising an elongated body having a plurality of axially spaced transversely extending fuel injector sockets, each of said sockets being adapted to receive a fuel injector suitable for delivering fuel from its socket to the engine, said body further having a pair of axially extending fuel passages, the lower portion of one of said passages intersecting said sockets for supplying fuel to said sockets, at least one end of said body having a circular recess intersected by and encompassing the associated ends of said fuel passages, and a circular plug received in and sealing said recess to provide a closure for the associated ends of said fuel passages, said one passage being characterized by vertical and horizontal dimensions, wherein the maximum vertical dimension of said one passage substantially exceeds the maximum horizontal dimension of said one passage whereby fuel vapor entrained in the fuel flowing through said one passage collects in the upper portion of said one passage and said lower portion of said one passage supplies only liquid fuel to said sockets, and wherein said one passage has an irregular configuration one side of which is outwardly convex and substantially conforms to the outline of said circular recess and the other side of which is outwardly concave and embraces said other passage to thereby provide a compact fuel rail.

2. A fuel rail for an engine, said rail comprising an elongated body having a number N of axially spaced transversely extending fuel injector sockets, each of said sockets being adapted to receive a fuel injector suitable for delivering fuel from its socket to the engine, said body further having a pair of axially extending fuel passages, one of said passages intersecting said sockets for supplying fuel to said sockets, each of said passages having a connection for receiving a fuel line with said fuel line connection of said one passage being disposed between two of said sockets, each end of said body having a circular recess intersected by and encompassing the associated ends of said fuel passages, and a circular plug received in and sealing each of said recesses to provide a single closure for the associated ends of said fuel passages, each of said plugs having a recess interconnecting said passages whereby the amount A of fuel flowing from one of said fuel line connections is divided with an amount B of such fuel flowing toward a number S of said sockets and the remaining amount A-B of such fuel flowing toward the remaining number N-S of said sockets, and wherein the sizes of said plug recesses are calibrated to cause the quantity B/A to substantially equal the quantity S/N and to cause the quantity (A-B)/A to substantially equal the quantity (N-S)/N.

3. A fuel rail for an engine, said rail comprising an elongated body having a number N of axially spaced transversely extending fuel injector sockets, each of said sockets being adapted to receive a fuel injector suitable for delivering fuel from its socket to the engine, said body further having a pair of axially extending fuel passages, the lower portion of one of said passages intersecting said sockets for supplying fuel to said sockets, each of said passages having a connection for receiving a fuel line with said fuel line connection of said one passage being disposed between two of said sockets, each end of said body having a circular recess intersected by and encompassing the associated ends of said fuel passages, and a circular plug received in and sealing each of said recesses to provide a single closure for the associated ends of said fuel passages, each of said plugs having a recess interconnecting said passages whereby the amount A of fuel flowing from one of said fuel line connections is divided with an amount B of such fuel flowing toward a number S of said sockets and the remaining amount A-B of such fuel flowing toward the remaining number N-S of said sockets, wherein the sizes of said plug recesses are calibrated to cause the quantity B/A to substantially equal the quantity S/N and to cause the quantity (A-B)/A to substantially equal the quantity (N-S)/N, said one passage being characterized by vertical and horizontal dimensions, wherein the maximum vertical dimension of said one passage substantially exceeds the maximum horizontal dimension of said one passage whereby fuel vapor entrained in the fuel flowing through said one passage collects in the upper portion of said one passage and said lower portion of said one passage supplies only liquid fuel to said sockets, and wherein said one passage has an irregular configuration one side of which is outwardly convex and substantially conforms to the outline of said circular recess and the other side of which is outwardly concave and generally conforms to the configuration of said other passage to thereby provide a compact fuel rail.

* * * * *